US012698144B2

(12) United States Patent
Mauder et al.

(10) Patent No.: US 12,698,144 B2
(45) Date of Patent: Aug. 4, 2026

(54) INSULATION CONTAINER FOR TEMPERATURE-SENSITIVE GOODS, IN PARTICULAR FOR TEMPERATURE-CONTROLLED STORAGE AND/OR TEMPERATURE-CONTROLLED TRANSPORT OF GOODS

(71) Applicant: va-Q-tec AG, Würzburg (DE)

(72) Inventors: Tobias Mauder, Würzburg (DE); Marc Mölter, Würzburg (DE); Joachim Kuhn, Würzburg (DE); Fabian Eschenbach, Rottendorf (DE)

(73) Assignee: va-Q-tec AG, Würzburg (DE)

( * ) Notice: Subject to any disclaimer, the term of this patent is extended or adjusted under 35 U.S.C. 154(b) by 97 days.

(21) Appl. No.: 18/628,551

(22) Filed: Apr. 5, 2024

(65) Prior Publication Data

US 2024/0336423 A1 Oct. 10, 2024

(51) Int. Cl.
*B65D 81/38* (2006.01)
*F25D 3/08* (2006.01)

(52) U.S. Cl.
CPC ..... *B65D 81/3823* (2013.01); *F25D 3/08* (2013.01); *F25D 2303/082* (2013.01); *F25D 2303/08221* (2013.01); *F25D 2303/0844* (2013.01)

(58) Field of Classification Search
CPC ..... F25D 2302/0844
USPC ..... 62/457.7
See application file for complete search history.

(56) References Cited

U.S. PATENT DOCUMENTS

| | | | | |
|---|---|---|---|---|
| 2,555,126 | A * | 5/1951 | Greve | F25D 3/08 206/811 |
| 4,024,731 | A * | 5/1977 | Branscum | F25D 3/00 215/385 |
| 6,062,040 | A * | 5/2000 | Bostic | F25D 17/042 62/457.2 |
| 6,112,899 | A * | 9/2000 | Zeringue | A45C 11/20 206/541 |
| 7,040,115 | B1 * | 5/2006 | Lopez | F25D 3/08 62/530 |
| 8,327,659 | B2 * | 12/2012 | Winkler | F25D 3/08 220/592.25 |
| 10,676,267 | B2 * | 6/2020 | Seiders | B65D 81/3823 |
| 2008/0156815 | A1 * | 7/2008 | Coff | A47J 41/00 220/592.2 |

(Continued)

FOREIGN PATENT DOCUMENTS

| | | | |
|---|---|---|---|
| DE | 202016004013 | U1 | 10/2017 |
| DE | 202019104570 | U1 | 8/2019 |

(Continued)

*Primary Examiner* — Mollie Impink
(74) *Attorney, Agent, or Firm* — Mark Terry

(57) ABSTRACT

Insulation container for temperature-sensitive goods, in particular for temperature-controlled transport of goods, having a base body which, with a lid, surrounds an interior space serving to accommodate the goods, the interior space being thermally insulated from the exterior along walls of the insulation container by vacuum insulation elements and having a cooling element to be received in the region of the lid with respect to the interior space for cooling the goods accommodated in the interior space in order to produce a functional state of the insulation container, characterized in that the cooling element can be connected to the lid with the aid of clamp members.

16 Claims, 7 Drawing Sheets

(56) References Cited

U.S. PATENT DOCUMENTS

| | | | | |
|---|---|---|---|---|
| 2021/0309442 | A1* | 10/2021 | Kletzel | B65D 21/0213 |
| 2024/0300724 | A1* | 9/2024 | Van De Ven | B65D 51/24 |

FOREIGN PATENT DOCUMENTS

| | | | |
|---|---|---|---|
| DE | 202018105868 | U1 | 1/2020 |
| DE | 102020113630 | A1 | 11/2021 |

* cited by examiner

INSULATION CONTAINER FOR TEMPERATURE-SENSITIVE GOODS, IN PARTICULAR FOR TEMPERATURE-CONTROLLED STORAGE AND/OR TEMPERATURE-CONTROLLED TRANSPORT OF GOODS

CROSS-REFERENCE TO RELATED APPLICATIONS

This patent application claims priority to German utility patent application number 20 2023 101 773.8 filed Apr. 6, 2023, and titled "insulation container for temperature-sensitive goods, in particular for temperature-controlled storage and/or temperature-controlled transport of goods". The subject matter of patent application number 20 2023 101 773.8 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

The present invention relates to an insulation container for temperature-sensitive goods, in particular for temperature-controlled storage and/or temperature-controlled transport of goods.

BACKGROUND

Insulation containers of this generic type intended for temperature-stable intermediate storage and/or temperature-controlled transport of temperature-sensitive goods such as foodstuffs, beverages, chemicals, pharmaceutical products, serums, blood preserves and possibly even organs are already known in a large variety of different designs. Said containers are equipped with thermal insulation elements to achieve a heat-insulating effect. They exhibit low thermal conductivity in order to largely eliminate temperature changes due to heat conduction. Insulation elements often contain insulating materials such as EPP, EPS, PU foam, corrugated cardboard, shredded paper, cellulose or wood wool, wood shavings, wood fibers as well as straw, reeds, sea grass or sheep's wool, for example.

Compared to such insulation elements with such insulating materials, the use of vacuum insulation elements or vacuum insulation panels leads to significantly better thermal insulation. In such vacuum insulation containers, the vacuum insulation elements are generally located on the bottom, lid and circumferential side surfaces of such approximately cuboid-shaped insulation containers. The use of vacuum insulation elements enhances the insulating effect many times over. In this context, the vacuum insulation elements are generally surrounded on the outside by a polypropylene insert followed by a layer of expanded polypropylene (EPP) foam.

As disclosed, for example, in DE 10 2020 113 630 A1, vacuum insulation elements comprise a supporting body formed from fumed silica, microfiber materials, perlites or open-pored plastic foams and a plastic film sheath surrounding the same.

Depending on requirements, cooling elements with a predefined, stable outer shape or with a flexible bag shape are used in transport containers, in particular vacuum insulation transport containers, in addition to the temperature-preserving insulating effect of the container, for example for additional cooling. Such cooling elements, colloquially referred to as freezer or cool packs, have a heat transfer medium such as a cooling liquid or a gel, which are pre-cooled prior to use in a corresponding insulation container that can be used for transport purposes, for example. In addition to the use of CO2 in a solid aggregate state, i.e. dry ice, it is also conceivable to use latent heat storage materials, so-called phase change materials, in which the energy supplied is stored in the form of latent heat for a phase change from a solid to a liquid state. In transport or insulation containers, the cooling elements are usually either integrated into the lid or placed in corresponding receptacles on the lid in order to cool the stored goods in a compartment located under the lid. The arrangement in the lid enables easier handling (commissioning) of the box and ensures a distance kept to the product, e.g. to prevent freezer burn. On the one hand, known insulation and/or transport containers with a cooling element integrated into the lid or with receptacles specially designed for cooling elements are expensive to manufacture and, on the other hand, can only be used for transporting or storing goods to be cooled because cold air sinks to the bottom.

Document DE 20 2019 104 570 U1 discloses such a transport container for the passive refrigerated transport of medicines and/or foodstuffs, which has an outer container and an inner container that can be inserted into the outer container and removed from the outer container. The inner container forms an upwardly open inner container space for the goods to be transported. Thermal insulation elements such as vacuum insulation panels are arranged on the inside between the inner container on the outer container walls, an outer container lid and on the outer container bottom. Furthermore, PCM elements are arranged on the bottom and along the side walls between the inner container and the outer container.

Documents DE 20 2016 004 013 U1 and DE 20 2018 105 868 U1 are also known.

Due to the increased number of temperature-controlled intermediate storage and/or temperature-controlled transport operations, there is a need to equip transport and/or insulation containers with cooling elements depending on the requirements of the goods to be intermediately stored and/or transported. It should preferably be possible to remove the freezer/cool pack in order to replace individual parts in the event of damage. Furthermore, the individual parts (freezer/cool pack, lid, etc.) should be cleaned individually at regular intervals, in particular because condensed water can accumulate between freezer/cool pack and lid. In addition, different freezer/cool packs (e.g. for different temperature ranges) should be used flexibly for one box.

SUMMARY

The invention therefore has the object of providing an insulation container for temperature-sensitive products, which enables temperature control or temperature stabilization by means of an easily implementable and reversible accommodation of a cooling element, especially in conjunction with insulation with vacuum insulation elements.

This object is attained by an insulation container according to claim 1.

Accordingly, the invention provides an insulation container for temperature-sensitive goods, in particular for temperature-controlled storage and/or for temperature-controlled transport of goods, with a base body which, with a lid, surrounds an interior space serving to accommodate the goods, the interior space being thermally insulated from the exterior along walls of the insulation container by vacuum insulation elements, and with a cooling element to be received in the region of the lid with respect to the interior space for cooling the goods accommodated in the interior space in order to produce a functional state of the insulation container. The insulation container is characterized by the fact that the cooling element can be (reversibly) connected or is connected to the lid with the aid of clamp members.

BRIEF DESCRIPTION OF THE DRAWINGS

In the following, the invention is explained in greater detail with reference to exemplary embodiments in connection with the accompanying drawings, which are drawn to different scales. In the drawings.

DETAILED DESCRIPTION

Figure 1:
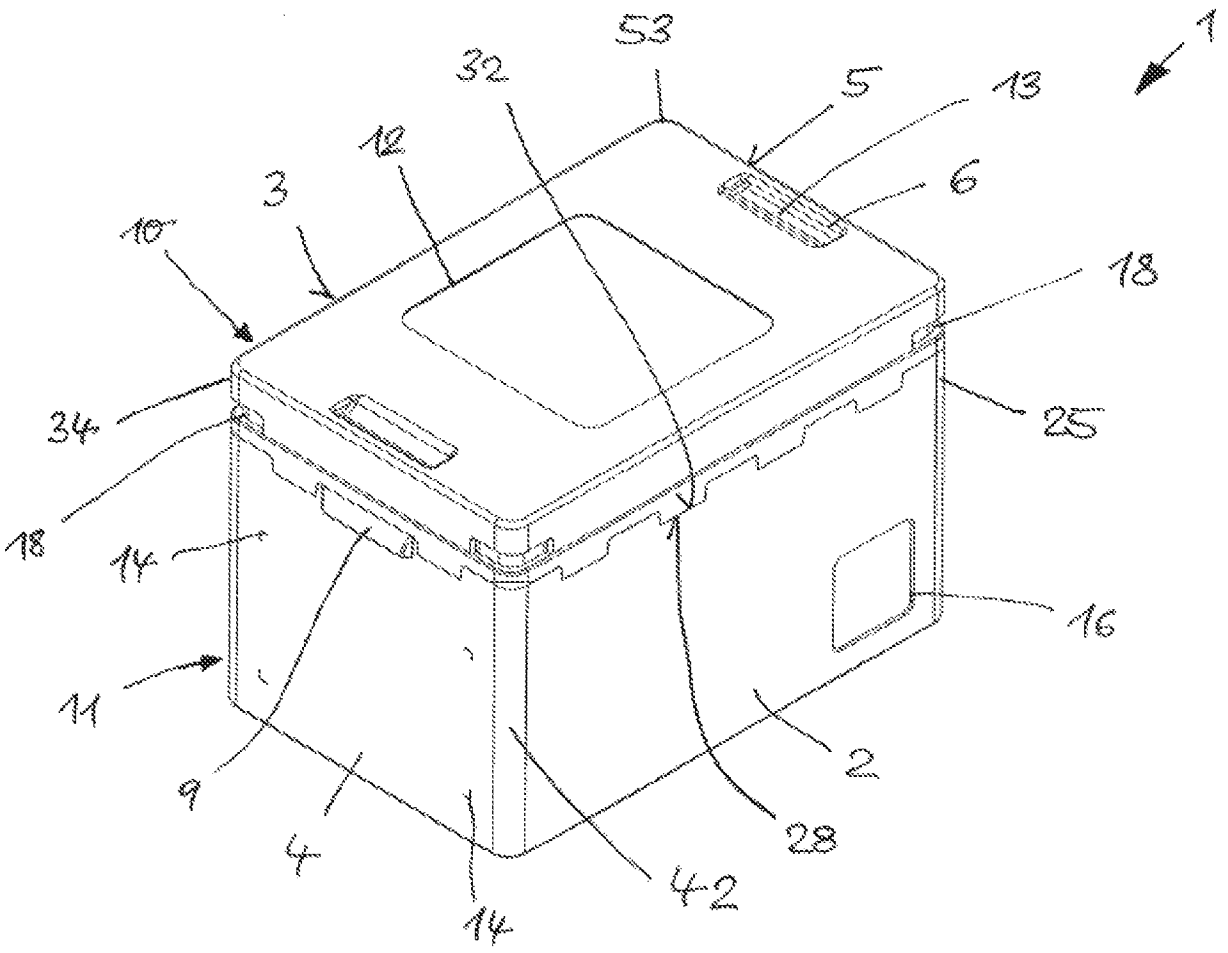
FIG. 1 shows a perspective view of an insulation container according to the invention.

The invention has the advantage that the insulation container according to the invention can be manufactured cost-effectively, especially in conjunction with high-quality insulation with vacuum insulation elements. The invention also enables the cooling element to be replaced easily. Furthermore, the use of a cooling element suitable for achieving the required specific temperature can be realized in a simple manner. This means that the freezer/cool pack can be removed in order to replace individual parts in the event of damage. Replacing the cooling elements is particularly important with regard to the good insulating properties of vacuum insulation elements, because specific temperature differences with temperature variants in specific narrow ranges can be realized here. The individual parts (freezer/cool pack, lid, etc.) can be cleaned individually at regular intervals, particularly because condensed water accumulates between freezer/cool pack and lid. In addition, different freezer/cool packs can be used flexibly for one box. Preferably, the vacuum insulation element and freezer/cool pack have approximately the same surface area or the vacuum insulation element is larger than the freezer/cool pack.

Further advantages are apparent from the sub-claims.

In one embodiment of the insulation container according to the invention, the clamp members for connecting the cooling element to the lid partially embrace the cooling element. This advantageously enables the vacuum insulation element to be the same or approximately the same size as the cooling element. This results in thermal advantages, as the cooling element is optimally insulated by means of the vacuum insulation element.

Preferably, the clamp members are essentially designed U-shaped and have a bridge section that lies below the cooling element or rests against the cooling element. Legs adjoining the bridge section are inserted into the lid in a functional state of the insulation container according to the invention.

In the embodiment of the insulation container according to the invention, in which the bridge sections of the clamp members lie below a projecting rim of the cooling element connected to the lid or rest against the rim of the cooling element, the cooling element can be fixed to the lid in a simple manner. The "projecting" rim is advantageously thicker on the outside at the edge than on the inside, which provides additional stability and therefore no bulging at retention points and ensures that the freezer/cool pack melts more evenly (more PCM in the rim region, which generally melts the fastest). Furthermore, the rim creates a buffer between the lid plate and the freezer/cool pack, i.e. thermal bulging of the lid plate could otherwise push the freezer/cool pack out of the retainer.

Preferably, the clamp members can be attached to the lid with socket sections provided on the legs. In a further embodiment of the insulation container according to the invention, the legs of the clamp members pass through slots in the lid to secure the cooling element and the socket sections interlock into blind hole-like recesses into which the terminate. Preferably, the blind hole-like recesses and the socket sections have a rhomboid-shaped cross-section. This allows the cooling element to be easily and securely fixed and retained on the lid.

When securing the cooling element to the lid, the clamp members are preferably inserted into an underside of the lid to secure the cooling element in such a way that they diagonally surround (or diagonally bypass or diagonally run across) corners or edges of the lid. Advantageously, the clamp members are supported by the rim of the inner container when the lid rests on the body and can therefore not fall out during transport.

The base body of the insulation container according to the invention can comprise an outer container and an inner container inserted into the outer container. Preferably, vacuum insulation elements are provided between the outer container and the inner container, which preferably form an insert provided between the outer container and the inner container. Such a modular design simplifies the assembly of the insulation container and thus realizes good mechanical stability.

Preferably, the inner container has a laterally projecting rim section, whereby projections provided on the inner container at its rim section projecting towards the bottom can engage into recesses provided in the upper rim of the outer container. The projections and the recesses are designed so as to fit together precisely and are essentially designed U-shaped. By designing the projections and recesses in this way, a castellated interlocking of the outer and inner container is achieved, which lends the insulation container good rigidity. Accordingly, the inner container is preferably received by the outer container with the rim section. This aspect realizes good dispersion of the load applied by the mass of the inner container to the outer container.

In yet another embodiment of the insulation container according to the invention, the lid has an outer lid plate, on the underside of which an indentation is provided for receiving a vacuum insulation element.

This embodiment of the insulation container according to the invention can be further developed in that the vacuum insulation element is accommodated in the indentation above the cooling element in a functional state of the insulation container according to the invention.

Figure 2:
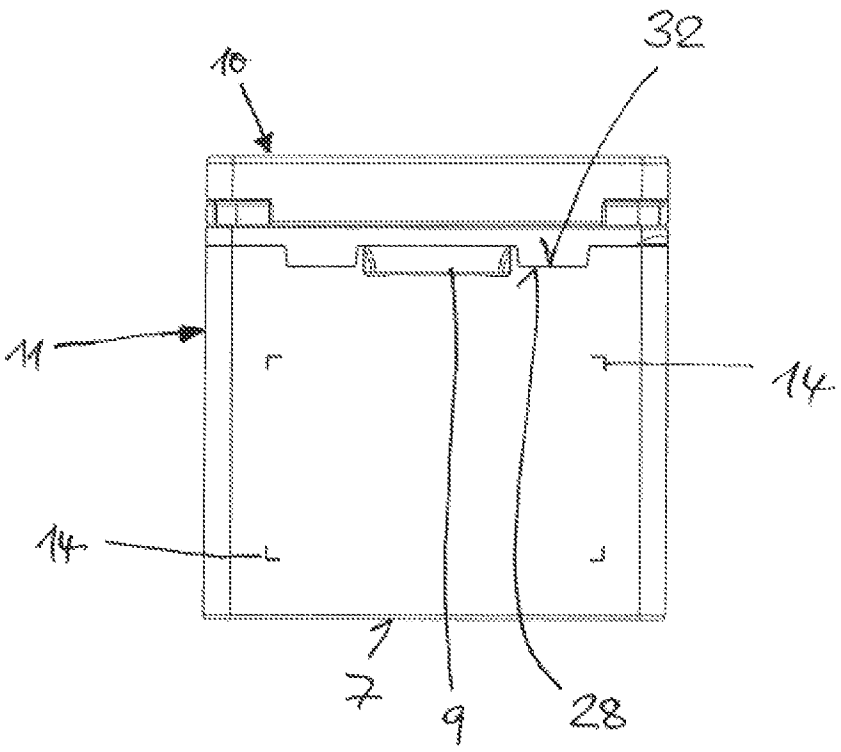
FIG. 2 shows a front view of the insulation container according to FIG. 1.

In FIG. 1 shows an insulation container for temperature-sensitive products, denoted with reference number 1, in the form of a transport container for temperature-controlled transport of products contained therein. Side walls 2, 3, each provided parallel to one another, are spaced apart by a front wall 4 and a rear wall 5 provided parallel to the latter. An interior space 8 (FIG. 4), which is surrounded by the side walls 2, 3, the rear wall 5, the front wall 4 and a bottom wall 7 and serves to accommodate goods such as merchandise, goods or the like, is closed off from the exterior by a lid 10. The lid 10 can be locked with the front wall 4 and the rear wall 5 to close the insulation container 1 in a manner known per se by engaging in opposing engagement indentations 11. For this purpose, locking elements 6 engage in counterparts 9 shown in FIG. 2. The insulation container 1 thus becomes a stable and closed unit. The lid 10 is connected to the body in this way via a tongue and groove system. The indentations in the corners 18 make it easier to grasp/remove the lid 10. The cavities 13 provided at the front side make it easier to grasp the box later and pull it out of the shelf. The protrusions 9 are used to lift the box. Components 9 and 13 have nothing to do with the closing of the lid 10 on the box.

Figure 3:
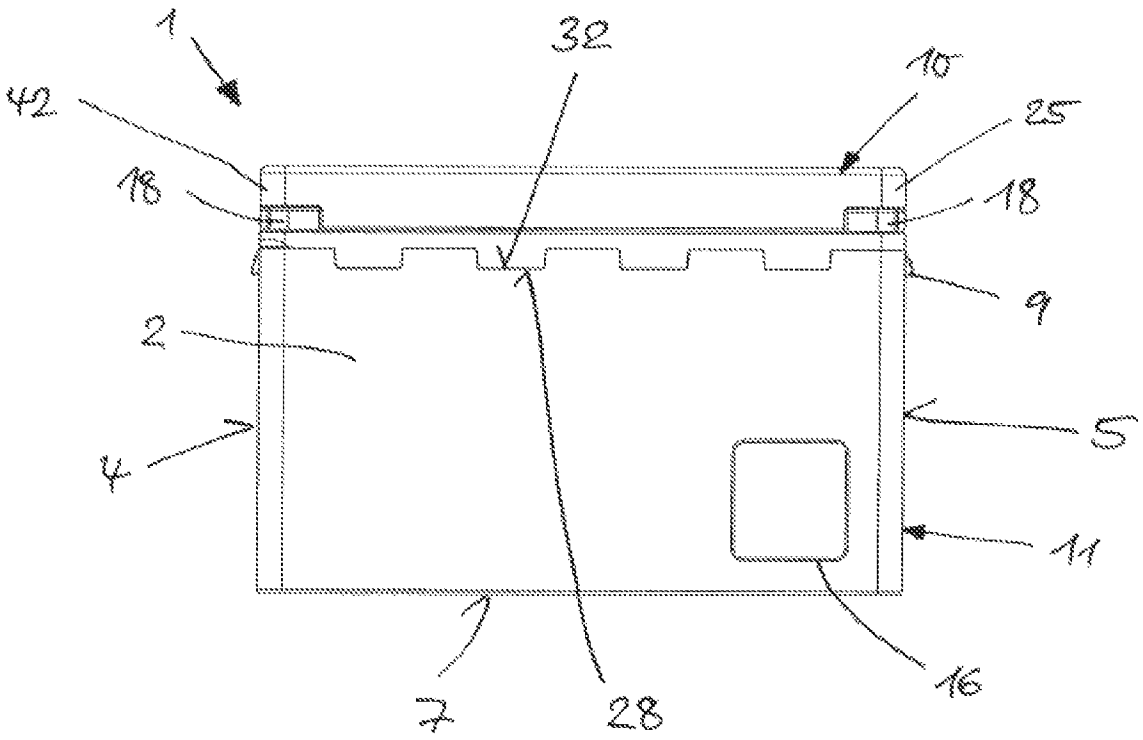
FIG. 3 shows a side view of the insulation container according to FIG. 1.

There is a cavity 12 provided on the lid 10, for example to accommodate a contents label to indicate the type of goods contained in the insulation container 1. A transport certificate or the like can be attached, preferably inserted or pushed in, to the front wall 4 in a region defined by angle pieces 14. On the side wall 2, the insulation container 1 according to the invention as shown in FIG. 3 has a further labelling device 16, which can also operate electronically or by radio transmission, in the region directed towards the rear wall 5 and towards the bottom wall 7 for labelling the contents of the container and/or with regard to its transport. From rounded edges 34, 42, 25, 53 of the essentially cuboid-shaped insulation container 1, engagement recesses 18 are provided in the lid 10, with the aid of which the lid 10 can be easily removed from the walls 2, 3, 4, 5 after releasing its interlocked connection.

Figure 4:
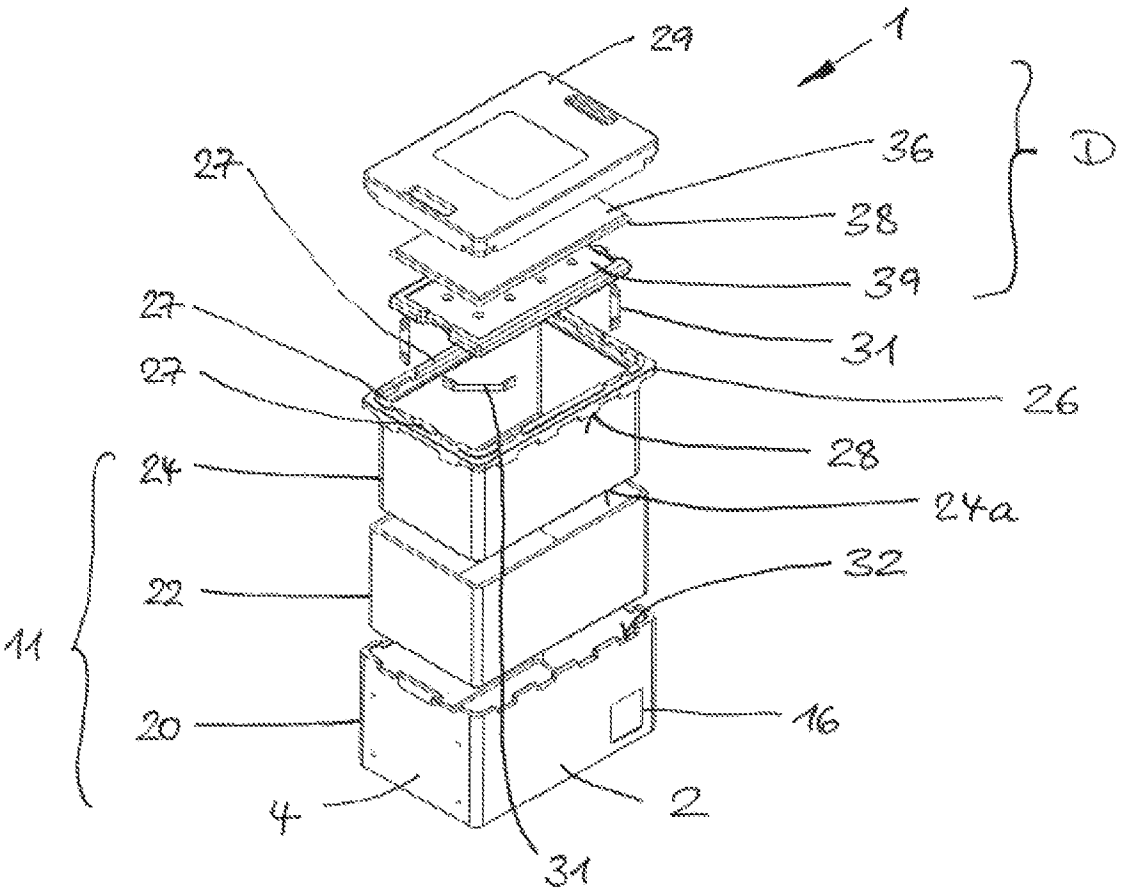
FIG. 4 shows an exploded view of the insulation container according to FIG. 1.

The structure of the insulation container 1 is shown in the exploded view in FIG. 4. A cuboid-shaped outer container 20, which is open at the top, accommodates an insulation insert 22 formed from vacuum insulation panels and closed at the bottom. An inner container 24 is inserted from an upper side of the insulation insert 22. The outer and inner containers 20 and 24, which are formed from a particle foam material such as preferably expanded polypropylene (EPP), and the insulating insert 22 form a base body 11, which together with the lid 10 forms the insulation container 1.

The inner container 24 has a laterally projecting rim section 26 opposite its bottom 24*a*. Projections 28, which are essentially designed U-shaped, project downwards from the circumferential rim section 26 parallel to the side walls of the inner container 24. As can also be seen from FIGS. 1, 3, the projections 28 engage into recesses 32 which are provided in the outer container 20 from the upper rim 20*b*. With the aid of the projections 28 of the inner container 24 and the recesses 32 of the outer container 20, a castellated interlocking of the two containers 20, 24 is achieved, which leads to a stabilization of the base body 11 and thus of the entire insulation container 1.

The lid unit D (FIG. 4), which in one functional state of the insulation container 1 has a multi-part structure, is formed by an outer lid plate 29, a rectangular insulating panel 36 provided underneath towards the bottom, an inner layer 38 made of plastic such as polypropylene and a cooling element 39 designed as a freezer/cool pack, which is pre-cooled accordingly to ensure the desired temperature. The insulating panel 36, the inner layer 38 and the cooling element 39 are inserted from the underside 29*a* into the outer lid plate 29 into an indentation 33 shown in FIG. 6.

Figure 5:
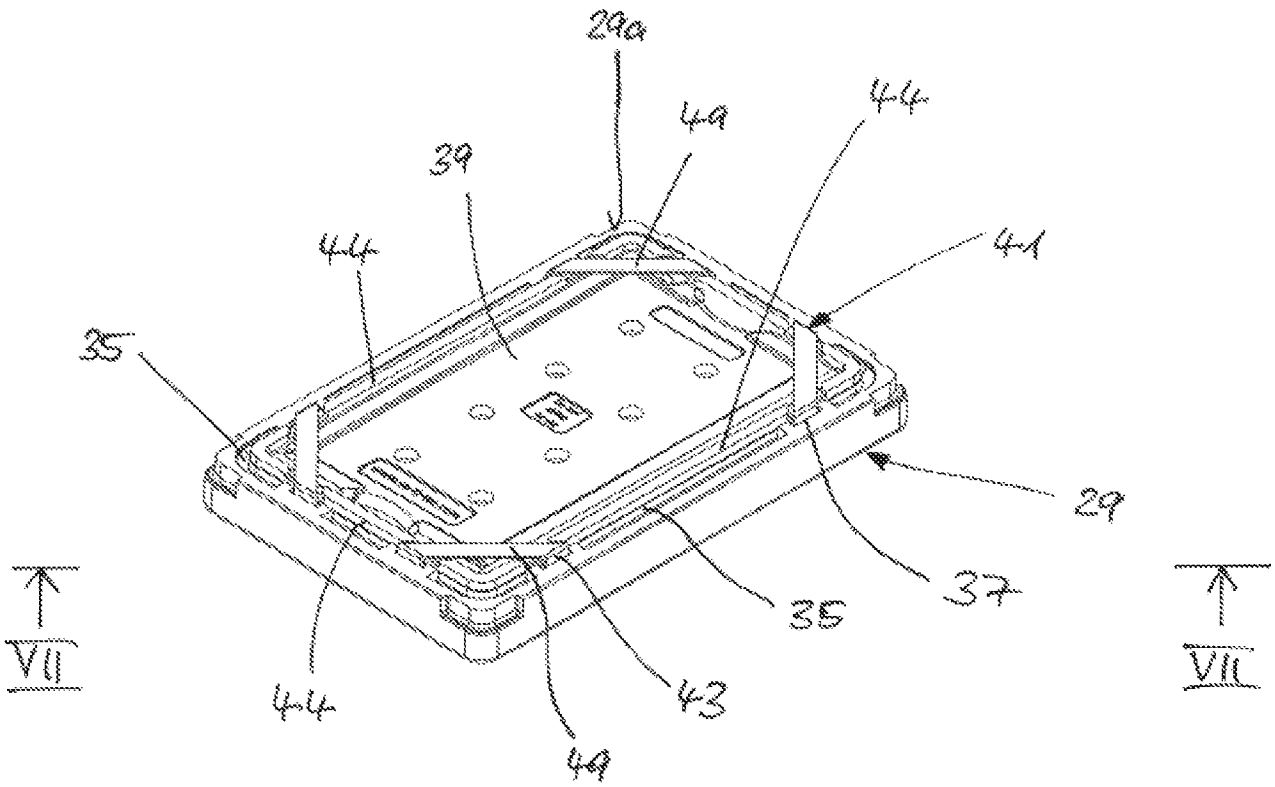
FIG. 5 shows a perspective view of a lid of the insulation container according to the invention from below.

On an underside 29*a* of the outer lid plate 29, indentation sections 35 are provided circumferentially at a distance according to FIG. 5, into which, in an assembled state of the insulation container 1 on the inner container 24, inner rim sections 27 also formed circumferentially and at a distance and profiled corresponding to the recess sections 35 engage—FIG. 4.

Figure 6:
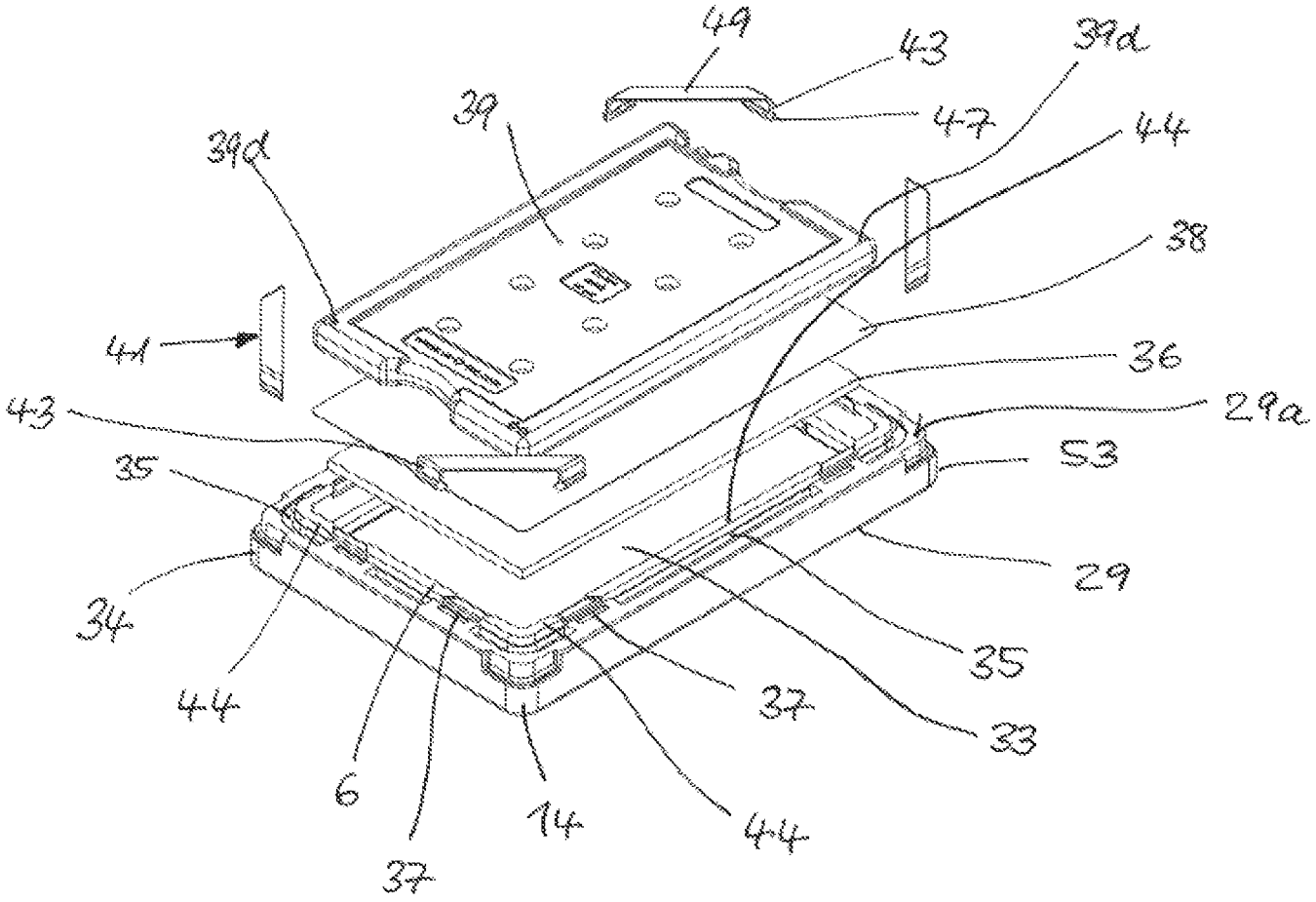
FIG. 6 shows an exploded view of the lid according to FIG. 5 from below.
Figure 7:
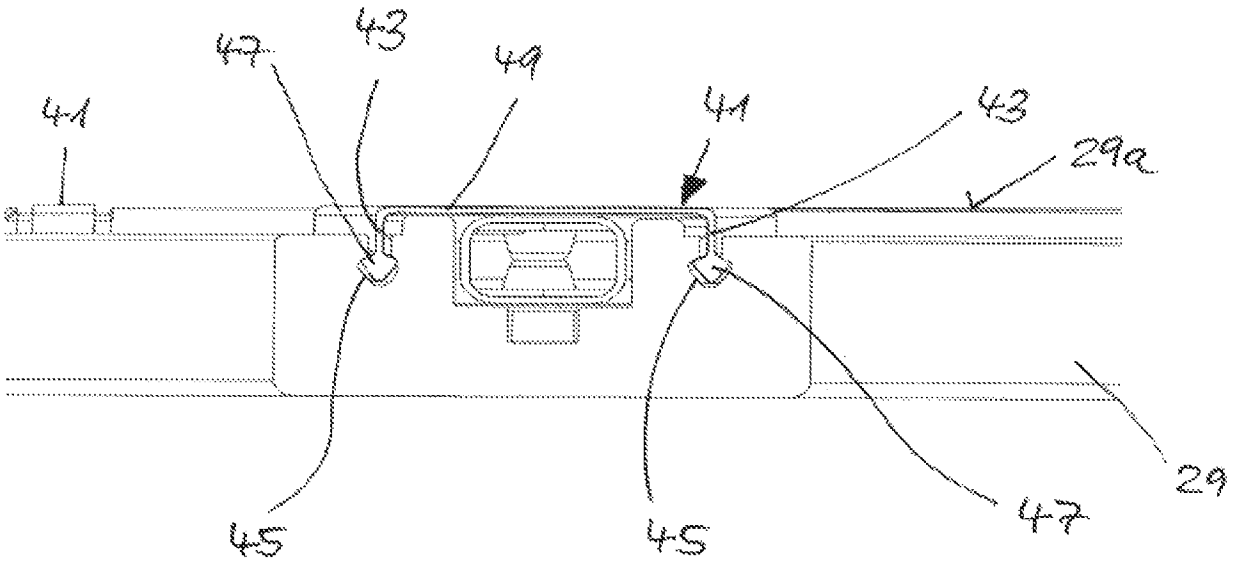
FIG. 7 shows a perspective view of the lid after a cut along line VII-VII in FIG. 5.

As shown in FIGS. 5, 6, the cooling element 39 is retained on the outer lid plate 29 with the aid of clamp members 41. An enclosure 44 surrounding the indentation 33 on the underside 29*a* of the outer lid plate 29 is interrupted with respect to the corners or edges 34, 42, 25, 53 for this purpose, so that the clamp members 41 diagonally surround the corners or edges 34, 42, 25, 53. According to FIGS. 5, 6, the essentially U-shaped clamp members 41 grip over corner regions 39*d* of the cooling element 39 to secure it to the outer lid plate 29. In this case, legs 43 of the clamp members 41 are inserted into slots 37 of the outer lid plate 29, which are recessed into the outer lid plate 29 from below in the rim region 31 on both sides of the corners or edges 34, 42, 25, 53 of the outer lid plate 29. The slots 37 terminate in the outer lid plate 29, which is also formed from a particle foam material such as preferably expanded polypropylene (EPP), into blind-hole-like recesses 45, which are essentially rhomboid-shaped in cross-section.

To secure the cooling element 39, the clamp members 41 are inserted with their legs 43 into the slots 37 and inserted or pressed into the outer lid plate 29, which is also formed from a particle foam such as preferably expanded polypropylene (EPP), until socket sections 47 provided at the free ends of the legs 43 with a substantially rhomboid-shaped cross-section penetrate into the blind-hole-like recesses 45 and are fixed therein in a barb-like manner. In doing so, the socket sections 47 rest firmly against the legs of the recesses 43 directed towards the slots 37. A bridge section 49 of the clamp members 41 is positioned so as to diagonally surround the rounded edges 34, 42, 25, 53 of the outer lid plate 29, in each case on the underside 29*a* of the outer lid plate 29.

What is claimed is:

1. An insulation container for temperature-sensitive goods, the insulation container comprising:

a base body comprising walls; and a lid;

the base body and the lid surrounds an interior space serving to accommodate the goods, the interior space being thermally insulated by vacuum insulation elements;

the lid further comprising a receiving region facing the interior space;

a cooling element house in the lid receiving region; and clamp members securing the cooling element to the receiving region, the claim members having a U-shape with bridge sections and legs, the bridge sections lie below the cooling element, ends of the legs of the U-shape are positioned within the lid.

2. Insulation container according to claim 1, characterized in that the bridge sections of the clamp members lie below a projecting rim of the cooling element connected to the lid.

3. Insulation container according to claim 1, characterized in that the clamp members are secured to the lid by means of socket sections provided on the legs.

4. Insulation container according to claim 3, characterized in that, in order to secure the cooling element, the legs of the clamp members pass through slots in the lid and the socket sections interlock in recesses into which the slots terminate.

5. Insulation container according to claim 4, characterized in that the blind hole-like recesses and the socket sections have a rhomboid-shaped cross-section.

6. Insulation container according to claim 1, characterized in that the clamp members are inserted so as to diagonally surround corners or edges of the cooling element into an underside of the lid in order to secure the cooling element.

7. Insulation container according to claim 1, characterized in that the base body comprises an outer container and an inner container inserted into the outer container.

8. Insulation container according to claim 7, characterized in that vacuum insulation elements are provided between the outer container and the inner container.

9. Insulation container according to claim 8, characterized in that an insert comprising the vacuum insulation elements is provided between the outer container and the inner container.

10. Insulation container according to one of claim 9, characterized in that the inner container has a laterally projecting rim section.

11. Insulation container according to claim 10, characterized in that the inner container has projections projecting from the rim section towards a bottom of the inner container and engaging into recesses which are provided at an upper rim of the outer container.

12. Insulation container according to claim 11, characterized in that the projections and the recesses are provided so as to fit together.

13. Insulation container according to claim 11, characterized in that the projections and the recesses are essentially U-shaped.

14. Insulation container according to claim 1, wherein the lid further comprises an outer lid plate with an indentation for receiving a vacuum insulation element.

15. Insulation container according to claim 14, characterized in that the vacuum insulation element is received in the indentation, wherein the indentation is positioned above the cooling element.

16. Insulation container according to claim 1, characterized in that the vacuum insulation element of the lid is of the same or approximately the same size as the cooling element of the lid.

* * * * *